US005649646A

United States Patent [19]

Foster et al.

[11] Patent Number: 5,649,646

[45] Date of Patent: Jul. 22, 1997

[54] CHILD RESISTANT NOZZLE

[75] Inventors: Donald D. Foster, St. Charles; Philip L. Nelson, Ellisville, both of Mo.

[73] Assignee: Contico International, Inc., St. Louis, Mo.

[21] Appl. No.: 458,802

[22] Filed: Jun. 2, 1995

[51] Int. Cl.[6] ..... B67D 5/32

[52] U.S. Cl. ..... 222/153.14; 222/383.1; 215/216; 215/237

[58] Field of Search ..... 222/153.01, 153.05, 222/153.06, 153.07, 153.14, 383.1; 239/333; 215/202, 209, 216, 223, 225, 237

[56] References Cited

U.S. PATENT DOCUMENTS

| | | | |
|---|---|---|---|
| 4,127,221 | 11/1978 | Vere | 222/153.14 X |
| 4,153,203 | 5/1979 | Tada | 222/383.1 X |
| 4,204,614 | 5/1980 | Reeve | 222/153.14 |
| 4,244,495 | 1/1981 | Lorscheid et al. | 222/153.14 |
| 4,257,561 | 3/1981 | McKinney | 222/153.14 X |
| 4,346,821 | 8/1982 | Wesner et al. | 222/153.14 X |
| 4,424,910 | 1/1984 | Heinol | 222/153.14 X |
| 4,516,695 | 5/1985 | Garneau | 222/153.14 |
| 4,606,480 | 8/1986 | Rodriguez Gazulla | 222/383.1 |
| 4,809,874 | 3/1989 | Pehr | 215/237 X |
| 4,852,770 | 8/1989 | Sledge et al. | 222/153.14 |
| 4,925,041 | 5/1990 | Pehr | 215/216 |
| 4,958,754 | 9/1990 | Dennis | 222/383.1 |
| 4,971,227 | 11/1990 | Knickerbocker et al. | 222/153.07 |
| 5,040,701 | 8/1991 | Knickerbocker et al. | 222/153.07 |
| 5,040,702 | 8/1991 | Knickerbocker et al. | 222/153.07 |
| 5,050,779 | 9/1991 | Knickerbocker | 222/153.14 |
| 5,088,628 | 2/1992 | Knickerbocker | 222/153.14 |
| 5,114,049 | 5/1992 | Knickerbocker | 222/384 X |
| 5,137,260 | 8/1992 | Pehr | 215/216 |
| 5,147,054 | 9/1992 | Pehr | 215/237 |
| 5,158,233 | 10/1992 | Foster et al. | 239/333 |
| 5,161,716 | 11/1992 | Knickerbocker | 222/153.1 |
| 5,169,032 | 12/1992 | Steijns et al. | 222/153.14 X |
| 5,228,600 | 7/1993 | Steijns et al. | 222/153.14 X |
| 5,238,152 | 8/1993 | Maas et al. | 222/153.14 X |
| 5,271,519 | 12/1993 | Adams et al. | 215/216 X |
| 5,344,053 | 9/1994 | Foster et al. | 222/383.1 |
| 5,356,017 | 10/1994 | Rohr et al. | 215/216 |
| 5,373,991 | 12/1994 | Nelson | 239/333 |
| 5,385,302 | 1/1995 | Foster et al. | 222/383.1 |
| 5,564,604 | 10/1996 | Tada | 222/383.1 |

FOREIGN PATENT DOCUMENTS

| | | | |
|---|---|---|---|
| 0 598 237 A2 | 5/1994 | European Pat. Off. | 239/333 |

*Primary Examiner*—Andres Kashnikow
*Assistant Examiner*—Kenneth Bomberg
*Attorney, Agent, or Firm*—Howell & Haferkamp, L.C.

[57] ABSTRACT

A fluid substance may be dispensed from a container with a fluid dispenser. The fluid dispenser has a housing connected to the container and a passage for providing fluid communication between a nozzle attached to the housing and the container. A pump positioned within the housing draws the fluid substance from the container interior and pushes the substance through an orifice in the nozzle. Attached to the housing is a pivotable door which is moveable between an open position wherein the fluid substance may be dispensed and a closed position wherein the door inhibits the fluid substance from being dispensed. The door has an aperture located remote from the nozzle orifice. Extending from the housing is a tongue which is configured to engage the aperture in the door when the door is in the closed position to prevent the door from being opened and to prevent the fluid substance from being dispensed from the nozzle orifice without first disengaging the tongue from the aperture and moving the door to the open position.

20 Claims, 2 Drawing Sheets

CHILD RESISTANT NOZZLE

BACKGROUND OF THE INVENTION (1) Field of the Invention

The present invention is directed to the field of fluid dispensers. In particular, the invention is directed to a fluid dispenser having a child resistant locking closure which prevents fluid from being dispensed through the dispenser without first disengaging the closure lock. The locking closure is child resistant in that two distinct motions in different directions are required in order to disengage the closure lock so that the fluid may be dispensed. In the preferred embodiment, the locking closure is integrally formed as part of a nozzle assembly.

(2) Description of the Related Art

There are numerous prior art patents directed to child resistant locking features used in fluid dispensers of the general type to which this invention relates. Generally a fluid dispenser of the type involved in the present invention is a relatively low-cost, hand-held trigger sprayer which may be operated by pulling a trigger to pump liquid from a container attached to the sprayer through a nozzle orifice at the front of the sprayer. Fluid dispensers of this type have a variety of features which have become well-known in the industry. For example, the dispenser may have a dedicated spray nozzle which produces a fixed spray pattern such as a narrow stream or a fine mist. Alternately, the fluid dispenser may be of the type which has a variable spray pattern. Still other fluid dispensers permit a foaming liquid to be dispensed as either a foam or a liquid spray. The child resistant nozzle of the present invention is equally well-suited for use in each of these types of fluid dispensers, as well as, virtually any other type of fluid dispenser.

Regardless of the type of fluid dispenser used, the fluids dispensed are frequently chemicals which are harmful or fatal if swallowed. Further, the chemicals are sometimes caustic and thus are harmful to individuals if they come in contact with the skin for any appreciable length of time. These harmful effects are frequently more pronounced in children because of their relatively small size and sensitive tissues. In addition, because children may not be able to read or understand textual or graphical warnings printed on the containers, they may not be able to appreciate the danger associated with the chemicals and thus have an increased risk of coming in contact with and being injured by these chemicals.

Although children may be more susceptible to being injured by chemicals dispensed from trigger sprayers, they are easier to protect from the harmful effects of the chemicals by physically locking the containers. Children may be prevented from accessing chemicals contained in a trigger sprayer by incorporating a locking closure on the trigger sprayer. Experience has shown that simply by requiring that two independent movements in different directions be performed in order to open a container, a significant number of children may be prevented from completing the tasks and others may be inhibited from completing the tasks for a sufficient length of time so that an adult may be alerted to the potentially harmful acts of the child and take appropriate action.

In the past, various types of locking closures have been developed to impede children from coming into contact with potentially harmful chemicals dispensed through fluid dispensers. Most of these locking closures require two different motions to open the closure and enable the fluid dispenser to dispense fluid. For instance, the child resistant nozzle assemblies disclosed in U.S. Pat. No. 4,204,614 of Reeve and in U.S. Pat. No. 4,257,561 of McKinney have rotating nozzle caps as are well-known in the art. These nozzle caps may be rotated between open and closed positions wherein the fluid is permitted and inhibited from being dispensed, respectively. However, the nozzle caps of the aforementioned references include slots and the housings include cantilevered lugs. The lugs align with and engage the slots when the caps are in the closed position to prevent the caps from being opened without first disengaging the lugs from the slots. Thus, to open these nozzle caps and permit dispensing of liquid through the nozzles, the lugs must be deflected upward or downward as the case may be to disengage the lugs from the slots. While the lug is disengaged from the slot, the nozzle must simultaneously be rotated to open the nozzle to permit the liquid to be dispensed. This motion generally requires two hands to perform. One hand disengages the lug while the other hand rotates the cap. Therefore, if the user is holding an article in one hand, such as a scrub brush or paper towel for use with a cleaning product being dispensed from the fluid dispenser, then this motion is difficult unless the user first sets the article down before attempting to open the child resistant nozzle cap.

Another child resistant fluid dispenser is disclosed in U.S. Pat. No. 5,114,049 of Knickerbocker. This reference discloses a latch which is pivotally connected to a trigger. The trigger is connected to the housing for pivoting movement in actuating a pump to dispense a liquid from the dispenser. When in the "on" position, the latch prevents the trigger from pivoting. However, the latch is flexible and may be deflected from the "on" position so that the latch does not interfere with pivoting the trigger. Thus, when the latch is deflected to the "off" position, the trigger may be actuated and the fluid may be dispensed from the fluid dispenser. Therefore, the user must use one motion to deflect the latch upward or downward and a second motion to actuate the trigger backward and forward in order to dispense liquid. However, these two motions may be accomplished with one hand. By grasping the fluid dispenser in one hand, the latch may be disengaged with the index finger while the trigger is actuated with the remaining three fingers of the hand. Therefore, with a simple grasping motion, the latch may be disengaged and the fluid may be dispensed. However, the simplicity of disengaging the latch detracts from the underlying purpose of preventing children from accessing the contents of the fluid dispenser.

Still another type of child resistant feature is disclosed in U.S. Pat. No. 4,346,821 of Wesner et al. which shows a fluid dispenser having a door with an aperture through it. The door slides relative to the nozzle orifice of the dispenser to alternately align and misalign the aperture with the nozzle orifice to alternatively permit and prevent dispensing liquid, respectfully. The door also includes a deflectable latch which engages against the housing when the door is in the closed position to prevent the door from being moved to the open position. To open the door, the user must deflect the latch forward and simultaneously slide the door upward to the open position to permit liquid to be dispensed from the fluid dispenser. However, the child resistant feature of the Wesner reference may be easily opened with one hand by pulling the latch forward and then upward, detracting from the purpose of preventing children from accessing the contents of the fluid dispenser.

Thus, each of the previously described fluid dispensers includes a child resistant locking feature which requires two motions in order to dispense fluid through the fluid dispenser. However, with some of these prior art locking features, the motion is simple and may be opened unintentionally or without much effort. Further, as a child becomes more familiar with a particular type of child resistant locking closure, he or she may discover how to unlock the closure and dispense fluid. Thus, there is a reoccurring need for new and unique child resistant locking closures which require different motions to open the closure and operate the fluid dispenser.

SUMMARY OF THE INVENTION

The fluid dispenser of the present invention includes a pivotable door which seals against a nozzle orifice in a closed position to prevent fluid from being dispensed through the nozzle of the fluid dispenser. Further, the door may be pivoted to an open position wherein the nozzle orifice is exposed so that the fluid may be dispensed. The door of the fluid dispenser includes an aperture and the dispenser includes a cantilevered tongue which may be inserted into the aperture. The tongue has a detent configured to engage the door when the tongue is inserted in the aperture to lock the door in the closed position. In order to disengage the tongue from the door, the user must deflect the tongue upward or downward to disengage the detent from the door prior to pivoting the door to the open position.

The child resistant locking feature of the present invention is unlike those in the prior art in its simplified construction that is incorporated into existing component parts of a trigger sprayer type liquid dispenser. Further, the motions required to disengage the detent and open the door may be accomplished with one hand, but are not so simple as to permit unintentional disengagement of the child resistant closure.

BRIEF DESCRIPTION OF THE DRAWINGS

Further objects and features of the present invention are revealed in the following Detailed Description of the Preferred Embodiment of the invention and in the drawing figures wherein.

DETAILED DESCRIPTION OF THE PREFERRED EMBODIMENT

Figure 1:
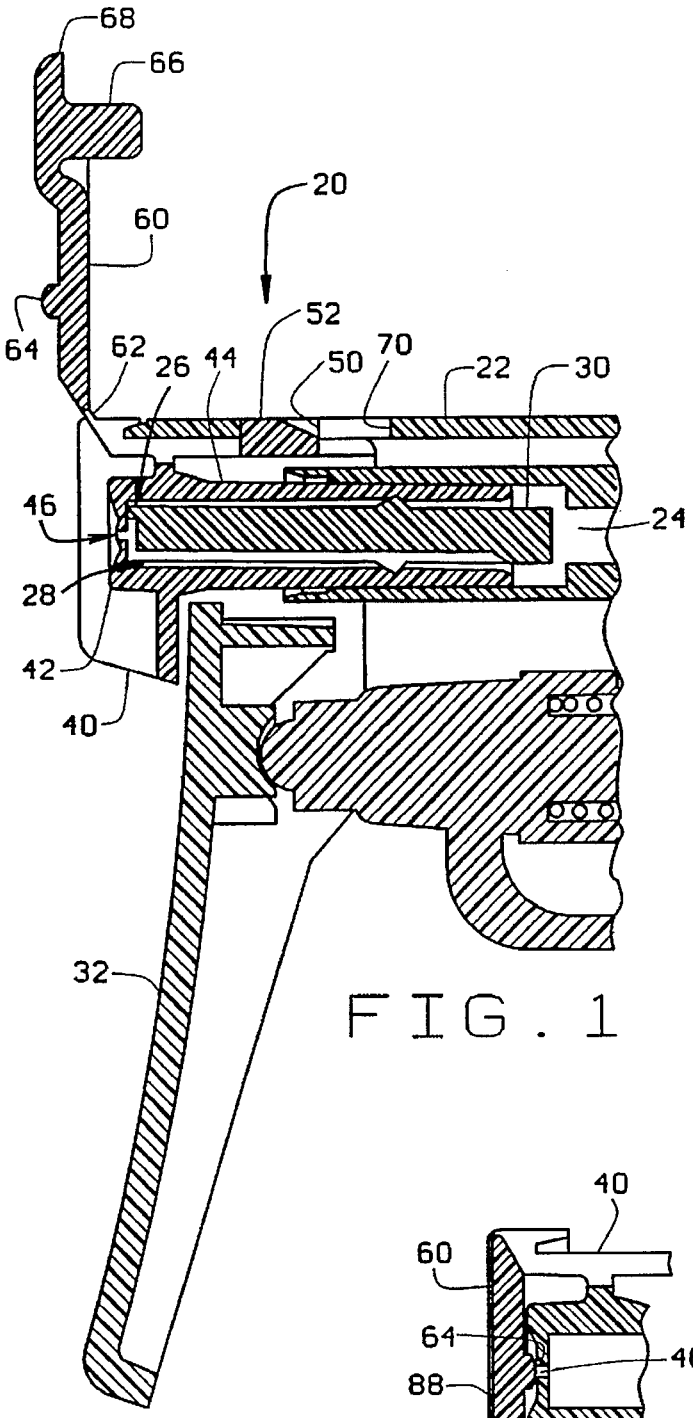
FIG. 1 is a cross-sectional view of a fluid dispenser having a door without a child resistant feature as is well-known in the prior art.

The nozzle of the present invention may be used in connection with many types of fluid dispensers including the trigger sprayers and foamers of the types disclosed in U.S. Pat. Nos. 5,344,053, 5,373,991 and 5,385,302 which are incorporated by reference into the present disclosure. However, the present invention may be applied to other types of fluid dispensers such as lotion pump and vertically-reciprocal spray dispensers. Thus, for convenience and brevity, all of these fluid dispenser types will hereinafter be collectively referred to as "fluid dispensers".

Typically, fluid dispensers 20 of the types used with the preferred embodiment of the present invention have a housing 22 which may be fastened to a container (not shown) by a closure (not shown). A passage 24 extends through the housing 22 from a first end (not shown) located within the interior of the container to a second end 26 located near the front of the housing 22. The second end 26 comprises a horizontal fluid discharge passage 28 which may be configured to accept a fluid spinner 30. The spinner 30 swirls liquid as it passes through the discharge passage 28 to improve the sprayer pattern of the liquid dispensed from the fluid dispenser 20. In addition, the fluid dispenser 20 includes a trigger 32 which is pivotally attached to the dispenser housing 22 and a pump (not shown) which may be actuated by manually pivoting the trigger to draw liquid from the container interior, and pump the liquid through the fluid discharge passage 28 to dispense the liquid.

Further, a nozzle assembly or nozzle 40 is positioned at the front of the housing 22 as shown in FIG. 1. The nozzle 40 includes a front wall 42 positioned adjacent the second end 26 of the passage 24 and a cylindrical tube 44 which extends from the front wall rearwardly into the housing 22 to form the forward end of the fluid discharge passage 28. An orifice 46 extends through the front wall 42 of the nozzle 40 through which liquid is dispensed from the fluid dispenser 20. Although other means of joining the nozzle 40 to the housing 22 are also contemplated, in the preferred embodiment, the housing includes a triangular hole 50 and the nozzle includes a protrusion 52 having a triangular cross section which engages with the hole in the housing to fasten the nozzle in place and to prevent the nozzle and housing from being separated. However, the nozzle assembly shown is illustrative only and the childproof closure of the invention may be attached to a trigger sprayer in any conventional manner and may be formed as an integral part of the trigger sprayer housing.

Figure 3:
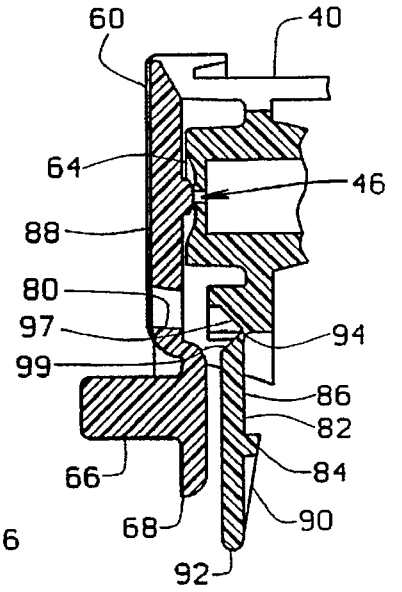
FIG. 3 is a cross-sectional view of the first embodiment of the child resistant nozzle showing the tongue in the non-engaging position and the door in the closed position.
Figure 4:
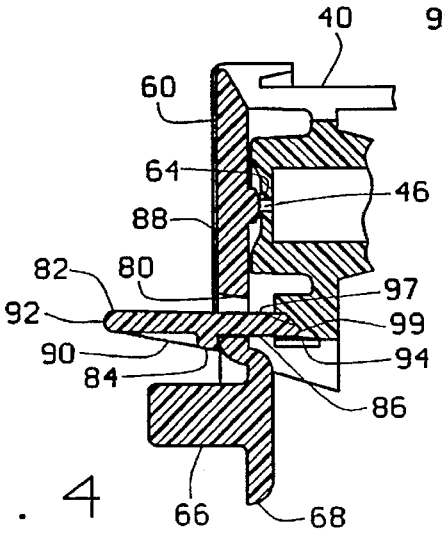
FIG. 4 is a cross-sectional view of the first embodiment showing the tongue in the engaging position and the door in the closed position.

In the preferred embodiment of the childproof closure, a door 60 is pivotally connected to the nozzle 40 by a living hinge 62. The door 60 may be moved between an open position (similar to the position shown in FIG. 1) where liquid may be freely discharged from the trigger sprayer through nozzle orifice 46, and a closed position (as shown in FIGS. 3 and 4) where the nozzle orifice is blocked so that liquid is prevented from being dispensed through the nozzle orifice. As shown in FIG. 1, the door 60 may include a semispherically-shaped projection 64 which seats against the nozzle orifice 46 to seal the orifice in the closed position of the door. Thus, when the door 60 is in the closed position, the projection 64 is seated against the nozzle orifice 46 so that the orifice is blocked and fluid is prevented from being dispensed. In addition, the door 60 may include one or more tabs 66, 68 extending from it in different directions to aid the user in grasping the door 60 when it is being opened and/or closed. One of the tabs 66 may be shaped and located so that it will fit within an aperture 70 provided in the housing 22 for holding the door 60 in its opened position. Still further, the door 60 may be pivotally connected directly to the housing rather than to a separate nozzle 40 as in the preferred embodiment. Although the nozzle 40 may be integrally formed with the housing or may be formed in several pieces, in the preferred embodiment the nozzle is a separate, one-piece assembly which seats within the fluid discharge passage 28 and which includes the door 60 integrally and pivotally connected to it. Thus, the door 60 is integrally molded with the nozzle 40 in the preferred embodiment to reduce the number of dispenser component parts and its overall manufacturing cost.

The dispenser 20 described above is fairly typical of prior art fluid dispensers and forms the background necessary to understand the child resistant nozzle of the present invention. Nonetheless, the aforementioned description is only representative of a typical fluid dispenser 20 in which the child resistant nozzle may be used and variations to this typical fluid dispenser may be made without departing from the scope of the invention as described and claimed.

Figure 2:
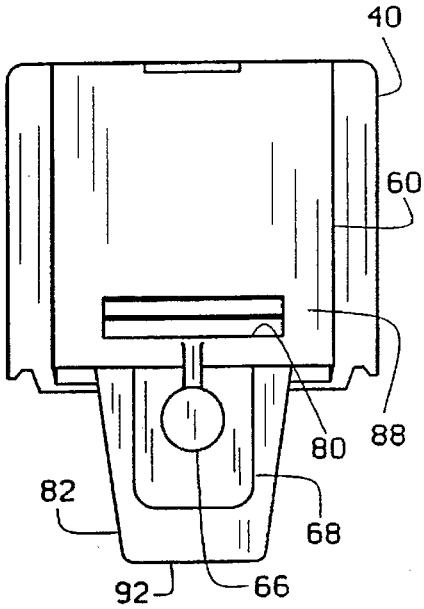
FIG. 2 is a front elevation view of the first embodiment of the child resistant nozzle of the present invention showing the tongue in the non-engaging position and the door in the closed position.

FIGS. 2–4 show a first embodiment of this invention. The common features of the first embodiment shown in FIGS. 2–4 and the typical prior art dispenser shown in FIG. 1 are indicated with identical numbers. A rectangular aperture 80 extends through the door 60 at a location which is between the tabs 66, 68 on the door and the protrusion 64 for sealing the nozzle orifice 46 when the door is in the closed position. A cantilevered tongue 82 extends forward from the nozzle 40 immediately behind the aperture 80 when the door 60 is in the closed position so that the tongue may be inserted through the aperture when the door is in the closed position as shown in FIG. 4. The tongue is connected to the nozzle assembly or the sprayer housing by a living hinge 94 similar to the hinge connecting the door 60 to the nozzle assembly. A fulcrum surface 97 is provided adjacent the hinge. In pivoting the tongue upwardly from its position shown in FIG. 3 to its position shown in FIG. 4, a bottom surface 99 of the tongue engages against the fulcrum surface 97 and prevents further pivoting movement of the tongue about the hinge. Thereafter, further upward movement of the tongue resiliently bends the tongue. The tongue is bent upwardly a small amount as the tip 92 of the tongue passes through the door aperture 80.

A detent 84 extends downwardly from the lower side 86 of the tongue 82 and seats against the outer surface 88 of the door when the door is moved to the closed position, thereby holding the door 60 in place. A ramp 90 extends from the tip 92 of the tongue 82 to the bottom of the detent 84. The ramp eases the passing of the tongue 82 through the aperture 80 causing the tongue to bend upwardly as the door 60 is closed, thereby enabling the door aperture 80 to pass over the detent without interference from the detent. The resilience of the tongue 82 is such that, once the aperture 80 passes over the detent 84 as the door 60 is closed, the resilience of the tongue will bias the tongue downwardly causing the detent 84 to seat over the outer surface 88 of the door. Thus, the door 60 is prevented from being opened without first unseating the detent 84 from the outer surface 88 of the door by bending the tongue 82 upwardly. Further, the tongue 82 extends forward of the detent 84 so that it may be easily grasped to bend the tongue 82 upwardly and unseat the detent from the door surface.

The hinge 94 permits the tongue 82 to be rotated downward to a disengaging position as shown in FIGS. 2 and 3 which prevents the tongue from engaging the aperture 80 when the door is in the closed position. Thus, if the child resistant locking feature of the nozzle of the present invention is not desired, the user may simply pivot the tongue 82 downwardly to the disengaging position to prevent engagement of the tongue 82 in the aperture 80 and to disable the child resistant locking feature.

Figure 5:
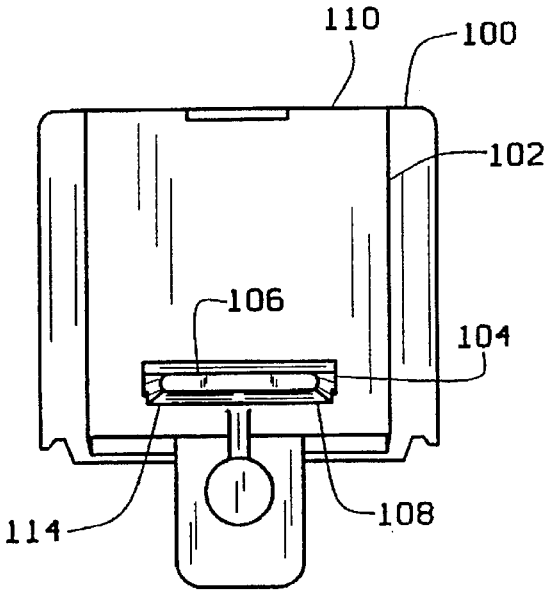
FIG. 5 is a front elevation view of the second embodiment of the child resistant nozzle of the present invention.
Figure 6:
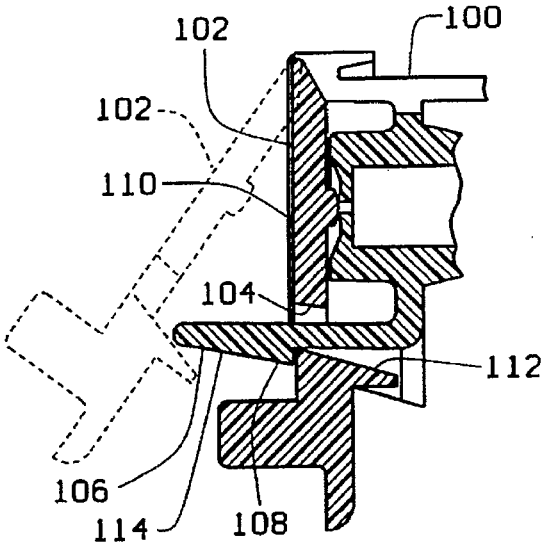
FIG. 6 is a cross-sectional view of the second embodiment of the child resistant nozzle.

A second embodiment of the present invention is shown in FIGS. 5 and 6. As with the first embodiment, the nozzle 100 of the second embodiment has a door 102 with a rectangular aperture 104. Also as in the first embodiment, the nozzle 100 has a tongue 106 which engages with the aperture 104 of the door 102 when the door is moved to the closed position. However, the tongue 106 is not pivotally connected to the nozzle assembly. Therefore, the tongue 106 of the second embodiment may not be moved to a disengaging position to prevent the tongue from engaging the aperture 104. A detent 108 extends downwardly from the tongue 106 to seat against the outer surface 110 of the door 102 when in the closed position. Both the door 102 and tongue 106 have ramps 112, 114 to aid in the alignment of the tongue and aperture 104 as the door is closed and to bend the tongue upwardly as the aperture passes over the detent 108.

To disengage the locking closure, the tongue is bent upwardly so that the door aperture 104 may pass over the tongue detent 108 as the door is pivoted toward its open position.

Figure 7:
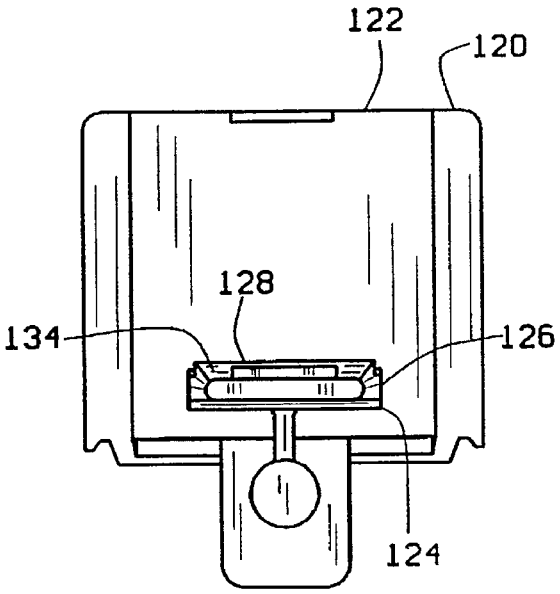
FIG. 7 is a front elevation view of the third embodiment of the child resistant nozzle of the present invention.
Figure 8:
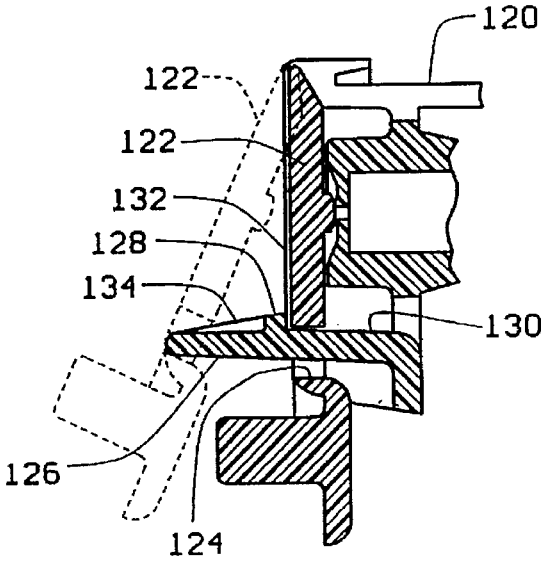
FIG. 8 is a cross-sectional view of the third embodiment of the child resistant nozzle.

A third embodiment of the fluid dispenser nozzle 120 is shown in FIGS. 7 and 8. This embodiment of the nozzle 120 also has a door 122 with a rectangular aperture 124. The door 122 of the third embodiment is similar to that of the second embodiment except that the ramp on the door has been omitted from the door of the third embodiment. The third embodiment also includes a tongue 126 with a detent 128 extending from the upper side 130 of the tongue. The detent seats against the outer surface 132 of the door 122 when the door is moved to the closed position to prevent the door from being opened without first displacing the tongue downwardly. As with the other embodiments, a ramp 134 extends from the tip of the tongue 126 to the detent 128 to aid in the insertion of the tongue into the aperture 124.

To use the fluid dispensers associated with each of the three child resistant locking feature embodiments, the user must first deflect the tongue either upwardly in the embodiment of FIGS. 2–6, or downwardly in the embodiment of FIGS. 7 and 8, to unseat the detent of the tongue from the outer surface of the door. Then, while holding the tongue in its deflected position and using a second movement, generally perpendicular to the first, the user grasps one of the tabs on the door, pivots the door forwardly, and slides the aperture over the detent and tongue to disengage the tongue from the aperture. The door may then be moved to a position similar to that shown in FIG. 1 or pivoted further to the rear to a horizontal position to engage the tab 66 in the housing aperture 70 in order to hold the door in the fully-opened position. With the door in either of the open positions, the user may actuate the trigger to pump the fluid from the interior of the container attached to fluid dispenser and through the nozzle orifice.

When the user is finished dispensing the fluid, he or she may grasp one of the tabs, disengage the tab from the aperture if necessary and pivot the door to the closed position as shown in FIGS. 4, 6 or 8. As the door is closed, the tongue penetrates the aperture and the ramp deflects the resilient tongue upwardly or downwardly to permit the detent to pass through the aperture. Once the tongue detent passes through the aperture, the resilience of the tongue material biases the tongue toward its undeflected position with the detent engaging over the outer surface of the door.

If use of the child resistant locking feature of the embodiment of FIGS. 2–4 is not desired, the user may simply pivot the tongue downwardly to the disengaging position shown in FIG. 3 in which it does not engage the aperture as the door is closed. When the tongue is in the disengaging position, the door may be opened without the necessity of unseating the detent from the outer surface of the door.

While the present invention has been described by reference to specific embodiments, it should be understood that modifications and variations of the invention may be constructed without departing from the scope of the invention defined in the following claims.

What is claimed is:

1. A nozzle of a trigger sprayer that discharges liquid pumped through the nozzle by the trigger sprayer, the nozzle comprising:

a fluid discharge passage extending through the nozzle, the fluid discharge passage having an inlet opening at a rearward end and a front wall at an opposite forward end of the fluid discharge passage;

a discharge orifice passing through the front well;

a door connected to the nozzle above the front wall for movement of the door between open and closed positions relative to the nozzle, the door being displaced from the discharge orifice when in the open position and the door covering over the discharge orifice when in the closed position, the door having a projecting tab on an edge of the door opposite its connection to the nozzle and the door having an aperture through the door positioned adjacent the projecting tab;

a tongue projecting forwardly from the nozzle below the front wall, the tongue extending to a distal end of the tongue positioned forwardly of the front wall, and the tongue holding its distal end stationary relative to the nozzle in a position where the tongue distal end will pass through the door aperture as the door is moved from its open position to its closed position and the tongue has a detent formed thereon adjacent its distal end, the detent is sized to pass through the aperture when the door is moved from its closed position to its open position.

2. The nozzle of claim 1, wherein:

the door aperture is positioned relative to the tongue to cause the tongue to bend as the door is moved to its closed position and the detent passes through the aperture.

3. The nozzle of claim 2, wherein:

the door has opposite interior and exterior surfaces, the interior surface opposes the discharge orifice and the exterior surface is positioned furthest from the orifice when the door is moved to the closed position, and the detent engages over the door exterior surface when the door is moved to the closed position.

4. The nozzle of claim 1, wherein:

the door has a peripheral edge, the aperture is positioned within the door peripheral edge, and the door tab projects from the door peripheral edge.

5. The nozzle of claim 1, wherein:

when the door is in the closed position both the door aperture and projecting tab are positioned on an opposite side of the discharge orifice from the connection of the door to the nozzle.

6. The nozzle of claim 1, wherein:

the tongue is spaced entirely below the nozzle front wall providing clear access to the tongue by a finger of a user's hand.

7. The nozzle of claim 1, wherein:

the fluid discharge passage has a center axis and the tongue distal end projects from the nozzle generally parallel to the center axis, the tongue has a proximal end connecting the tongue to the nozzle, the proximal end extends from the nozzle generally perpendicular to the center axis, and the tongue has a bent portion connecting its distal end to its proximal end, the bent portion giving the tongue distal end a resilience.

8. A nozzle of a trigger sprayer that discharges liquid pumped through the nozzle by the trigger sprayer, the nozzle comprising:

a fluid discharge passage extending through the nozzle, the fluid discharge passage having an inlet opening at a rearward end and a front wall at an opposite forward end of the fluid discharge passage;

a discharge orifice passing through the front wall;

a door having a peripheral edge connected to the nozzle above the front wall for movement of the door between open and closed positions relative to the nozzle, the door being displaced from the discharge orifice when in the open position and the door covering over the discharge orifice when in the closed position, the door having a tab projecting from its peripheral edge opposite its connection to the nozzle and the door having an aperture through the door and positioned adjacent the tab where, when the door is in the closed position, both the aperture and tab are positioned on an opposite side of the discharge orifice from the connection of the door to the nozzle;

a tongue projecting forwardly from the nozzle below the front wall, the tongue extending to a distal end of the tongue positioned forwardly of the front wall where the tongue distal end will pass through the door aperture as the door is moved from its open position to its closed position and the tongue has a detent formed thereon adjacent its distal end, the detent is sized to pass through the aperture when the door is moved from its closed position to its open position.

9. The nozzle of claim 8, wherein:

the tongue is formed integrally with the nozzle and holds its distal end stationary relative to the nozzle.

10. The nozzle of claim 9, wherein:

the fluid discharge passage has a center axis and the tongue distal end projects from the nozzle generally parallel to the center axis, the tongue has a proximal end connecting the tongue to the nozzle, the proximal end extends from the nozzle generally perpendicular to the center axis, and the tongue has a bent portion connecting its distal end to its proximal end, the bent portion giving the tongue distal end a resilience.

11. The nozzle of claim 9, wherein:

the door aperture is positioned relative to the tongue to cause the tongue to bend from its stationary position relative to the nozzle as the door is moved to its closed position and the detent passes through the aperture.

12. The nozzle of claim 11, wherein:

the fluid discharge passage has a center axis and the door has opposite interior and exterior surfaces, the interior surface opposes the discharge orifice and the exterior surface is positioned furthest from the discharge orifice along the fluid discharge passage center axis when the door is in the closed position, and the detent engages over the door exterior surface when the door is in the closed position.

13. The nozzle of claim 8, wherein:

the tongue is spaced entirely below the nozzle front wall providing clear access to the tongue by a finger of a user's hand.

14. A nozzle of a trigger sprayer that discharges liquid pumped through the nozzle by the trigger sprayer, the nozzle comprising:

a fluid discharge passage extending through the nozzle, the fluid discharge passage has a center axis with an inlet opening at a rearward end and a front wall at an axially opposite forward end of the fluid discharge passage;

a discharge orifice passing through the front wall;

a door having a peripheral edge connected to the nozzle shove the front wall for movement of the door between open and closed positions relative to the nozzle; the door being displaced from the discharge orifice when in the open position and the door covering over the discharge orifice when in the closed position, the door having a tab projecting from its peripheral edge opposite its connection to the nozzle and the door having an aperture through the door and positioned adjacent the a tongue projecting forwardly from the nozzle below the front wall, the tongue has a distal end that projects from the nozzle generally parallel to the fluid discharge passage center axis, the tongue has a proximal end connecting the tongue to the nozzle, the proximal end extends from the nozzle generally perpendicular to the fluid discharge passage center axis, and the tongue has a bent portion connecting its distal end to its proximal end and positioning the distal end relative to the nozzle where the distal end will pass through the door aperture as the door is moved to its closed position.

15. The nozzle of claim 14, wherein:

the tongue bent portion holds the distal end stationary relative to the nozzle and gives the distal end a resilience.

16. The nozzle of claim 15, wherein:

the tongue has a detent formed thereon adjacent its distal end, and the door aperture is positioned relative to the tongue to cause the tongue to bend from its stationary position relative to the nozzle as the door is moved to its closed position and the detent passes through the aperture.

17. The nozzle of claim 16, wherein:

the door has opposite interior and exterior surfaces, the interior surface opposes the discharge orifice and the exterior surface is positioned furthest from the discharge orifice along the fluid discharge passage center axis when the door is in the closed position, and the detent engages over the door exterior surface when the door is in the closed position.

18. The nozzle of claim 14, wherein:

the aperture is positioned within the door peripheral edge.

19. The nozzle of claim 14 wherein:

when the door is in the closed position both the door aperture and projecting tab are positioned on an opposite side of the discharge orifice from the connection of the door to the nozzle.

20. The nozzle of claim 14, wherein:

the tongue is spaced entirely below the nozzle front wall providing clear access to the tongue by a finger of a user's hand.

* * * * *